US006213205B1

(12) United States Patent
Surjaatmadja

(10) Patent No.: US 6,213,205 B1
(45) Date of Patent: Apr. 10, 2001

(54) PRESSURE ACTIVATED BENDABLE TOOL

(75) Inventor: Jim B. Surjaatmadja, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/257,437

(22) Filed: Feb. 25, 1999

(51) Int. Cl.[7] ..... E21B 17/20; E21B 7/08
(52) U.S. Cl. ..... 166/242.2; 175/67; 175/73
(58) Field of Search ..... 166/50, 313, 117.5, 166/242.1, 242.2, 242.6; 175/73, 67

(56) References Cited

U.S. PATENT DOCUMENTS

| | | | | |
|---|---|---|---|---|
| 3,743,034 | | 7/1973 | Bradley | 175/61 |
| 4,895,214 | | 1/1990 | Schoeffler | 175/38 |
| 4,928,776 | | 5/1990 | Falgout, Sr. | 175/45 |
| 5,029,654 | | 7/1991 | Wilson et al. | 175/74 |
| 5,259,467 | | 11/1993 | Schoeffler | 175/38 |
| 5,269,385 | | 12/1993 | Sihlis | 175/74 |
| 5,343,966 | * | 9/1994 | Wenzel et al. | 175/74 |
| 5,503,235 | | 4/1996 | Falgout, Sr. | 175/61 |
| 5,669,457 | * | 9/1997 | Sabastian et al. | 175/73 |

FOREIGN PATENT DOCUMENTS 2 324 818 11/1998 (GB) .

* cited by examiner

*Primary Examiner*—David Bagnell
*Assistant Examiner*—Kamal Dawelbeit
(74) *Attorney, Agent, or Firm*—Robert A. Kent; Stephen R. Christian

(57) ABSTRACT

A pressure activated bendable tool assembly having a longitudinal centerline, the tool assembly comprising an adapter sub for connection to an end of a tubular member having a bore extending longitudinally therethrough and a plurality of bend elements positioned in a serial relationship also having a bore extending longitudinally therethrough, the bore being in fluid communication with the bore of the adapter sub and each adjacent bending element. The bend elements are axially retained by a plurality of retainer sleeves. The retainer sleeves limit the amount the bend elements may be longitudinally displaced from each other about a preselected side of the retainer sleeve element. A head-sub forms a distal end of the tool assembly opposite of the adapter sub. The tool assembly bends with respect to the longitudinal centerline a preselected amount upon inducing a pressure differential between the respective bores of the adapter sub, the bend elements, and the head-sub and the ambient pressure of the tool assembly.

20 Claims, 5 Drawing Sheets

PRESSURE ACTIVATED BENDABLE TOOL

CROSS REFERENCE TO RELATED APPLICATIONS

Not Applicable

MICROFICHE APPENDIX

Not Applicable

FEDERALLY SPONSORED RESEARCH OR DEVELOPMENT

Not Applicable

BACKGROUND OF THE INVENTION

This invention generally relates to tools used in the exploration and production of oil and gas, and relates more particularly to downhole well tools capable of being bent, or deflected, to a pre-selected angle with respect to a longitudinal reference line upon internal pressurization of the tool to achieve or enhance certain downhole operations.

BRIEF SUMMARY OF THE INVENTION

A pressure a activated bendable tool assembly having a longitudinal centerline, the tool assembly comprising an adapter sub for connectedly adapting the tool assembly to an end of a tubular member, the adapter sub having a bore extending longitudinally therethrough and having a means for providing a fluid connection between the tubular member and the tool assembly. A first bend element having a bore extending longitudinally therethrough, the bore being in fluid communication with the bore of the adapter sub. A second additional bend element having a bore extending therethrough for accommodating a portion of a bend element positioned longitudinally proximate to the second additional bend element. At least one retainer sleeve for axially retaining the first and second bend elements, the retainer sleeve further having a means for limiting the amount the first and second bend elements may be longitudinally displaced from each other about a preselected side of the retainer sleeve element. A head-sub means for forming a distal end of the tool assembly opposite of the adapter sub. Wherein the tool assembly bends with respect to the longitudinal centerline a preselected amount upon inducing a pressure differential between the respective bores of the adapter sub, the bend elements, and the head-sub and the ambient pressure of the tool assembly.

A preselected number of bending elements and retainer sleeves may be installed to achieve the desired total amount of arc in which the tool is to bend upon being pressurized.

The head-sub may be replaced with a jetting sub containing a jet nozzle for performing jetting operations. The subject tool assembly is particularly suitable for use in carrying out jetting operations or entry operations in multilateral wellbores or horizontal wellbores when connected to coiled tubing or composite coiled tubing.

Preferably the bend elements have external shoulders which coact with internal tangs on the sleeve retainers to axially restrain the bending elements along a preselected side to cause the bend elements to form an arc about the longitudinal axis of the tool assembly upon being pressurized. Preferably the shoulders have notches therein to allow the tangs of the retainer sleeves to slip about the bending elements and to be rotatably positioned thereabout.

Preferably set screws or other lock means are provided for non-bindingly securing the retainers about their respective bend elements, and adaptor and head sub if appicable, to prevent the retainer sleeves from rotating out of position by engaging the slots in the shoulders of the bending elements.

DETAILED DESCRIPTION OF THE INVENTION

Figure 1:
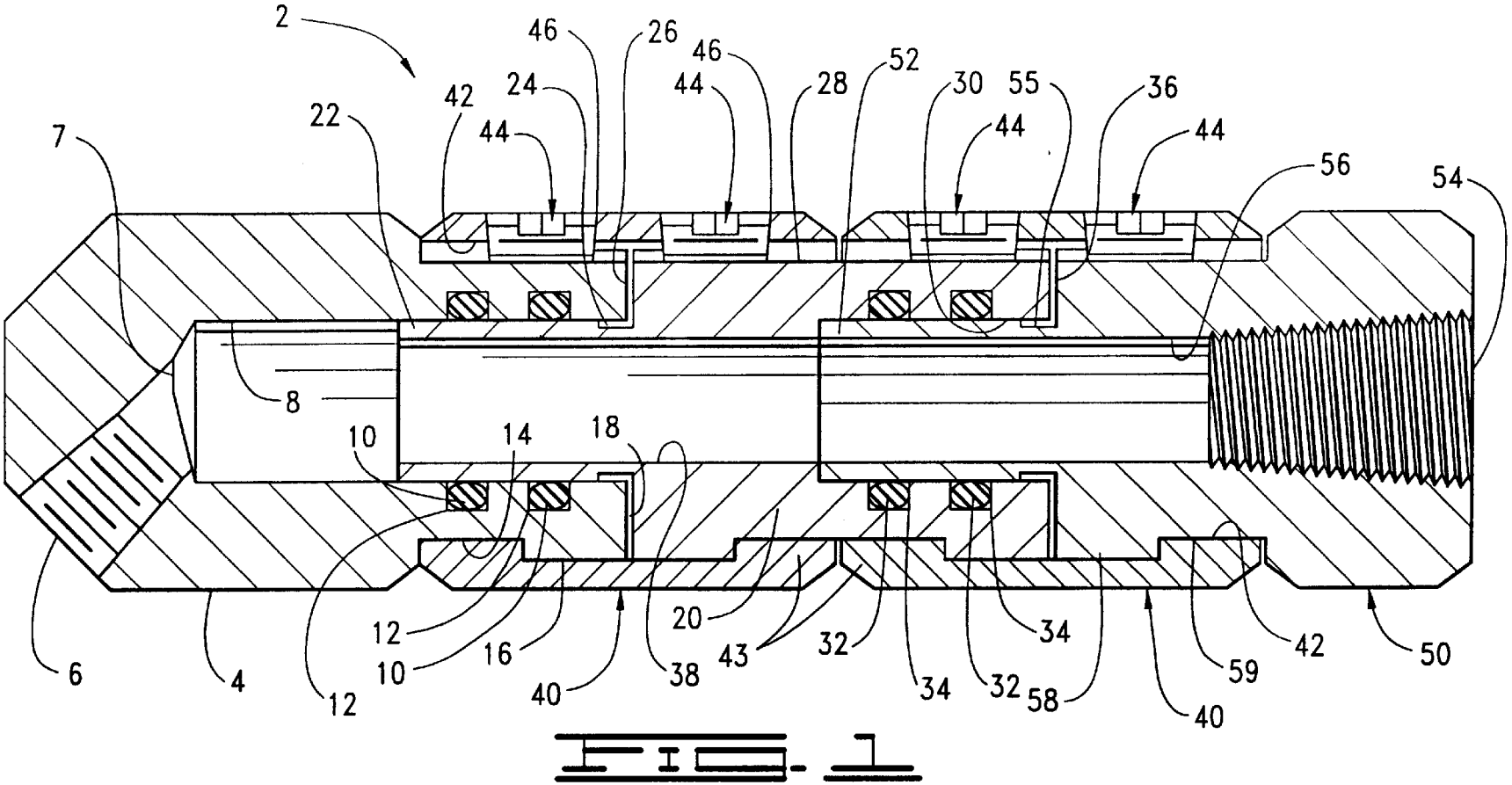
FIG. 1 is a cross-sectional front view of an embodiment of the disclosed bending tool assembly having a jetting head.

Referring now to FIG. 1 of the drawings showing an embodiment of a pressure activated bending tool assembly 2. Assembly 2 includes a jetting-sub 4, a bend element 20, two retainer-subs, alternatively referred to as sleeve retainers, 40, and an adapter 50 for connecting the assembly to another tool or to a connector that has been attached to a section of coiled tubing. The components can be machined or fabricated of steel, stainless steel, or any material having adequate chemical resistance and structural strength to survive conditions expected to be encountered in subterranean wells. Only one bend element 20, also referred as a bend unit, has been depicted to simplify the illustration. However, it is contemplated that a plurality of bend elements would be installed in a serial sequence in order to obtain the desired amount of bend, or lateral deflection upon the tool assembly being pressurized.

Jetting head 4 has a jet-receiving bore 6 for accommodating commercially available jetting nozzles. Such jetting nozzles are available in a wide variety of configurations and sizes and therefore the receiving bore will be designed to sealingly engage and secure such jetting nozzles. Jet receiving bore 6 is in communication with jet passage 7 which in turn is in communication with internal bore 8 which provides a flow path for the fluid medium to be used for jetting, typically water. Within internal bore 8, proximate to opposite end face 18, are O-rings 10 installed within respective grooves 12. The exterior of jetting head 4 has a relieved outer diameter portion 14 and a larger outer diameter shoulder 16.

Bend element 20 is provided with a mandrel 22 sized to be slidably accommodated by internal bore 8 of jetting head 4 and to be sealed thereabout by O-rings 10. Adjacent first face 26, which is designed to abut face 18 of jetting head 4, there is a slight groove 24 about mandrel 22 which allows for mandrel 22 to better clear the edge of mandrel receiving bore 30 when multiple bend elements are utilized and the tool assembly is pressurized to induce a bending of the components. The exterior of bend element 20 is provided with a reduced outer diameter 28 that resides between a pair of raised circumferential shoulders 25 in which end face 26 defines the outer end of one shoulder and a second end face 36 which in turn defines the outer end of the second shoulder. Extending generally longitudinally through bend element 20 is a fluid passage bore 38 of at least one pre-selected internal diameter. The fluid passage bore has an enlarged portion 30 beginning at end face 36 and extending toward mandrel 22. Within enlarged bore 30 is at least one and preferably two grooves 34 for receiving respective O-rings 32.

Adapter sub 50 is provided with a mandrel 52 having a longitudinal fluid passage bore 56 extending throughout adapter sub 50. Opposite mandrel 52, a bore 56 is preferably provided with a threaded portion 54 in order for the adapter to be attached to another tool, or to a connector that has been installed upon the end of a section of coiled tubing. A reduced outer diameter region 59 is located approximately midway of adapter 50. An increased outer diameter defining a shoulder 58 is positioned between region 59 and mandrel 52. Mandrel 52 is sized and configured, preferably essentially identical to mandrel 22 of bend element 20 and mandrel 52 is received and sealed within bore 30 of bend element 20.

Retainer-sub 40 is designed to be slidably installed about, at least a large portion of the entire exterior of bend element 20, portions of jetting head 4, and adapter 50. Retainer-sub 40 is essentially a hollow cylinder having an internal bore 42. Retainers, such as set screws 44 are removably installed within threaded retainer receptacle bores 46. As can be seen, retainers 44 protrude into internal bore 42 and are essentially flush with the outside surface of retainer-sub 40 when fully installed. Located diametrically opposite of retainers 44 are preferably rectangular-shaped tangs 43 which protrude into internal bore 42.

Figure 2A:
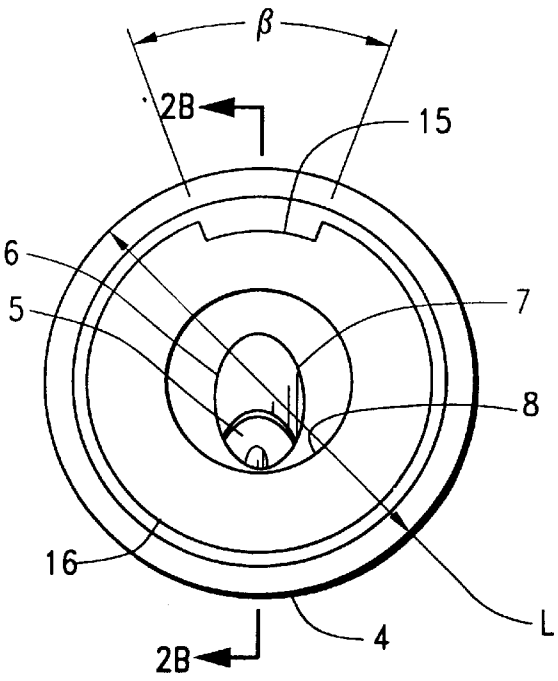
FIG. 2A is an end view of an end-sub forming a jetting head shown in the assembly illustrated in FIG. 1.
Figure 2B:
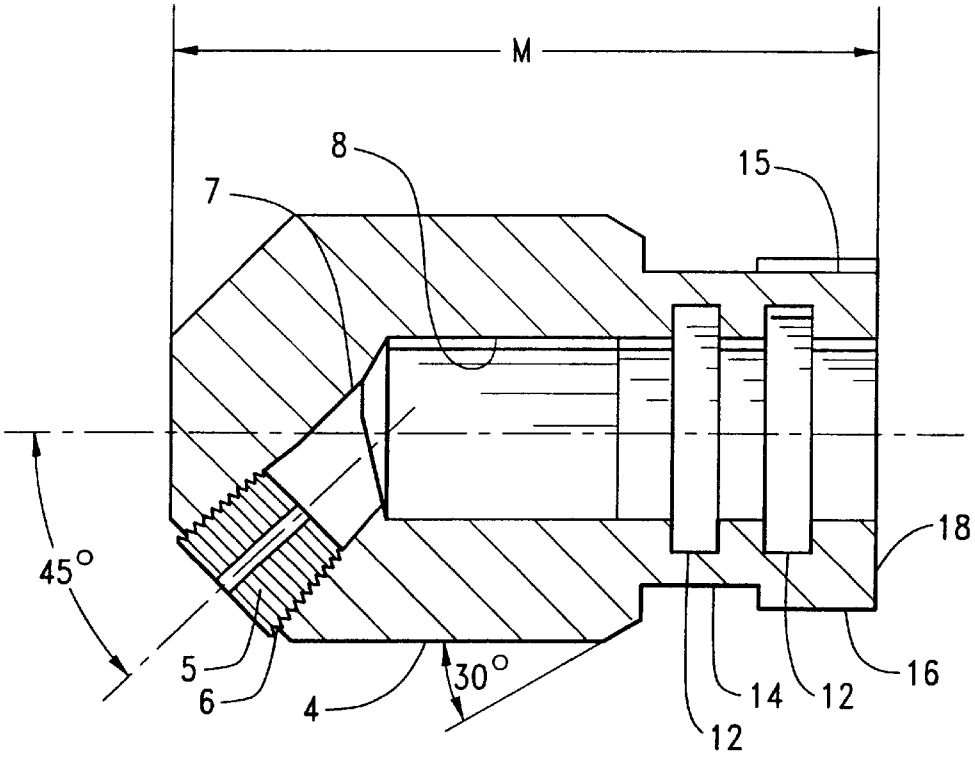
FIG. 2B is a cross-sectional view of the end-sub taken along line 2B—2B as illustrated in FIG. 2A.

Referring now to FIGS. 2A and 2B which show more detail of representative jetting head 4 shown in FIG. 1. Jetting head 4 is particularly suited for liquid, or slurry, jetting operations conducted with the subject bendable tool. Typically threaded jet receiving bore 6 is positioned at a pre-selected angle $\alpha$ from a longitudinal reference line for accommodating a pre-selected jet of a particular orifice diameter and spray profile that are well known in the art and commercially available generically illustrated as jet nozzle 5. An angle between 35° to 45° is commonly -used, however any angle can be used to best suit the operation being undertaken. Furthermore, more than one such bore 6 may be provided in order to accommodate jets in a plurality of locations so as to provide jetting from preselected locations within jetting head 4. For example, jetting bores/jets may be located on the same side of the jetting head or, jetting bores may be positioned on sides opposite from each other, or at any other circumferential and/or longitudinal location with respect to each other as deemed appropriate. Also multiple jetting bores/jets may be strategically provided to counteract reactive forces generated by spray exiting the primary working jets which causes the jetting head, as well as the attached tubing string, to move away from the targeted work area in the absence of such counteracting jets.

An arcuate notch 15 of a predetermined angle $\beta$, or alternatively a slot or channel of pre-selected width, is provided from face 18 through shoulder 16 to the smaller relieved shoulder 14. Notch 15 is for allowing the passage of tang 43 when installing retainer sub 40 shown in FIGS. 1, 4A, and 4B. The function and interaction of tang 43 and shoulder 16 will be described in further detail in due course.

Figure 3A:
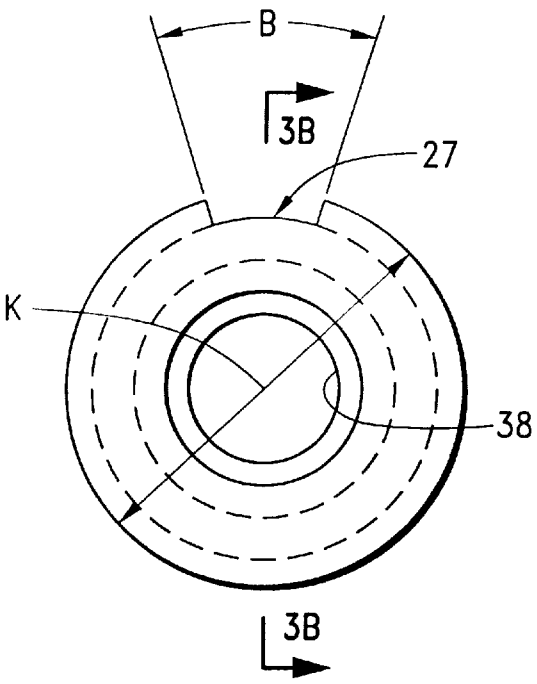
FIG. 3A is an end view of a bend element shown in the assembly illustrated in FIG. 1.
Figure 3B:
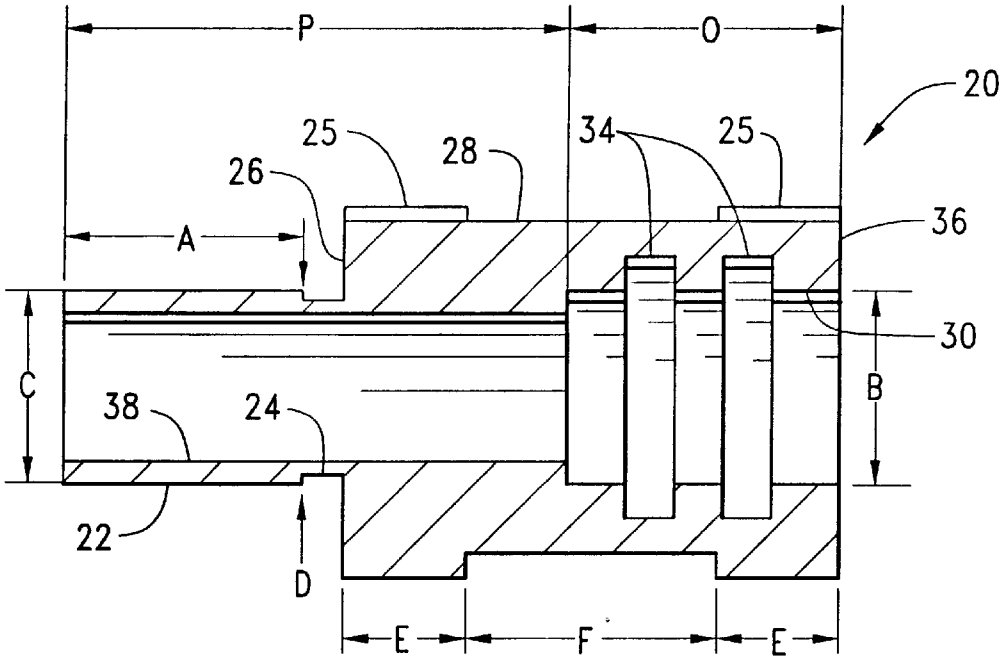
FIG. 3B is a cross-sectional view of the bend element taken along line 3B—3B as illustrated in FIG. 3A.

Referring now to FIGS. 3A and 3B which shows bend element 20 of FIG. 1 in more detail. As mentioned previously, bend element 20 is designed to be used singularly as shown in FIG. 1 or to be used in a group of several such elements to form a string of bend elements of a pre-selected number to provide the total desired bend, or total lateral reach, that the jetting head, or the lower most component of the tool assembly, needs to travel in a lateral direction with respect to the longitudinal centerline of the tool in order to perform a given operation upon pressurizing the tool assembly.

Dimension A is the length of the tapered portion of mandrel 22. Dimension B is the I.D. of receiving mandrel receiving bore 30. Dimension C is the O.D. of the free end of mandrel 22 and dimension D is the O.D. of the fixed end of mandrel 22. Dimension E is the length of shoulders 25. Dimension F is the spacing between shoulders 25. Dimension K is the O.D. of shoulders 25.

An essential feature of bend element 20 is hollow mandrel 22 and its co-action with receiving bore 30 of an adjacent bend element 22 in a string of bend elements is that the mandrel has a taper about its outside diameter. The inside diameter of the bore passing through mandrel 22 is not critical beyond it having a large enough bore to provide a desired fluid flow rate needed in relation to the pressures to be used. The taper preferably begins in the proximity of groove 24 of the fixed end of the mandrel and decreases in diameter as it extends outwardly toward the free end of mandrel 22. Dimension D of the fixed end is the largest O.D. of the taper and Dimension C of the free end is the smallest O.D. of the taper. That is the largest portion of the taper begins at Dimension D and the outside diameter of mandrel 22 gradually decreases until reaching the minimum outside diameter of mandrel 22 designated as Dimension C. Angle $\beta$ in FIG. 3 is the angle of arc of notches 15 in shoulders 25. Such notches serve the same function as notch 14 of jetting head 4 in that it allows a tang 43 located within bore 42 of retainer-sub 40 (shown in FIGS. 4A and 4B) to pass through the notch when installing retainer-subs 40 about a pair of adjacent bend elements.

Such a taper thereby allows the bend element 22 to laterally deviate a pre-selected amount of arc, typically 3° per bend segment 20, from an imaginary longitudinal reference line extending through bore 38, or several sequentially positioned bores 38 when a multiplicity of such bend elements are used, and/or bore 8 in the case of mandrel 22 of the last bend element 20 installed into bore 8 of jetting head 4.

Figure 4A:
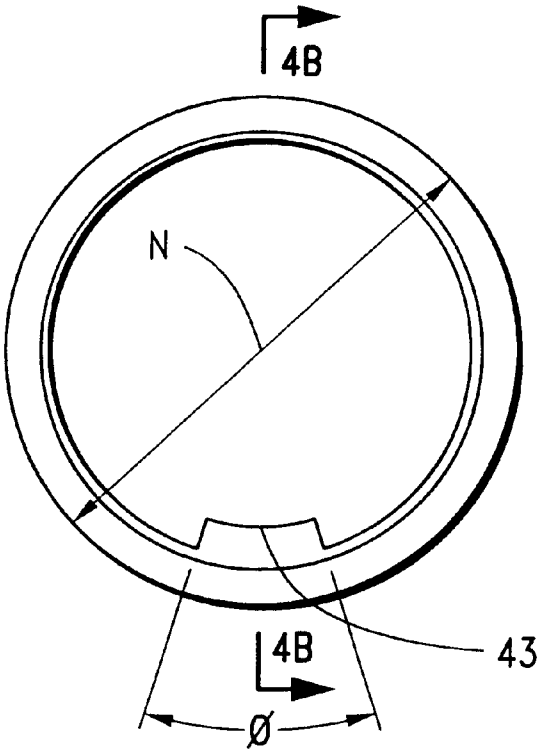
FIG. 4A is an end view of a retainer sub shown in the assembly illustrated in FIG. 1.
Figure 4B:
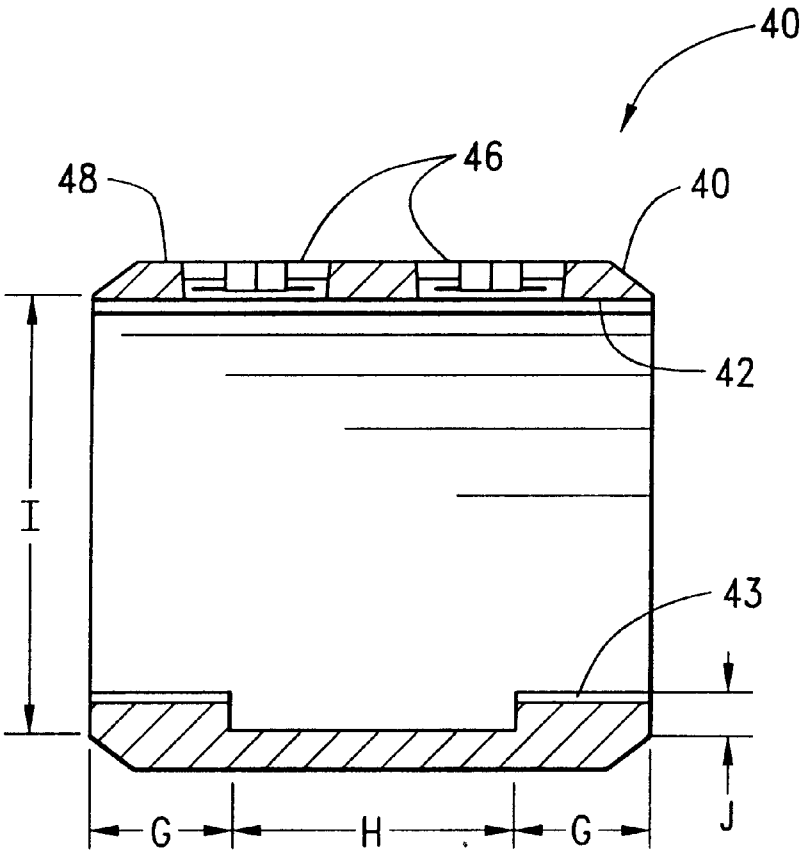
FIG. 4B is a cross-sectional view of the retainer-sub taken along line 4B—4B as illustrated in FIG. 4A.

Referring now to FIGS. 4A and 4B which are more detailed views of retainer-sub 40. Retainer-sub 40 has a pre-selected O.D. 48. Internal bore 42 has a nominal I.D. of dimension I which does not include tang 43 that protrudes into bore 42 by the distance denoted by dimension J. Tang 43 has a pre-selected circumference corresponding to angle $\phi$. As mentioned earlier, retainer receptacle bores 46 preferably are threaded to accommodate retainers such as brass set screws 44, not shown in FIG. 4, see FIG. 1, that when installed are preferably flush to the outer diameter of retainer sub 40. Screws 44 need not be a threaded brass screw, and can be made of any material having sufficient strength to secure retainer-sub 40 about: a pair of bend elements 20; a bend element 20 and a jetting sub 4; or a bend element 20 and an adapter sub 50 as shown in FIG. 1. Depending on the particular application in which the subject tool is to be used, the screws may need to be of steel or similar high strength material. As can also be seen in FIG. 1, the region between tangs 43 accommodates shoulder 16 of jetting head 4 adjacent shoulder 25 of bend element 20, and the other shoulder 25 of bend element 20 and adjacent shoulder 58 of adapter sub 50. The sizing of the above components is such that installation of retainer-sub 40 is easily achieved while maintaining the desired amount of clearance to allow for a predetermined amount of lateral movement of bend element 20 upon pressurization of the tool assembly.

In order to assemble a tool assembly having a pre-selected number of bend elements, a jetting head for example is selected and the mandrel of the bend element is installed into receiving bore 8 of the jetting head. Notch 15 of the jetting head and notches 27 of the bend element are aligned with each other, then a retainer-sub is slipped over the bend element and partially over the jetting sub by aligning tang 43 of the retainer sub with the notches 15 and 27. Upon the tangs clearing the notches the retainer-sub is rotated 180° with respect to the longitudinal axis so that the retaining screws are now aligned with and positioned above the notches.

The retaining screws are installed so as to project into notches 15 and 27. However, the screws are not bottomed out against the bend elements but are positioned such that the bend elements have a requisite amount of movement yet do not bind the elements. The lower most section of the retaining screws reside at least partially within the notches so that the retainer sub can not rotate about the longitudinal axis. The top most section of the retaining screws are preferably flush with the outside diameter to prevent snagging of the tool when being run downhole. The retaining screws can be made of brass or any suitable material and are preferably secured with a suitable commercially available thread locking compound. Means other than set screws can be used to retain the retainer sub in positions such as engagement dogs or dowel pins for example. Regardless, of the retaining means selected, care should be exercised in not allowing the installation to bind the subs and thus interfere with the desired amount of movement of the retainer and jetting subs. One tang 43 of the retainer sub is now positioned in portion 14 of the jetting sub and the other tang 43 of the retainer sub is positioned in the reduced outside diameter portion 28 of the bending element wherein shoulder 16 and shoulder 25 are sandwiched between the two tangs as shown in FIG. 1. The installation process is repeated until the pre-selected number of bending elements and retainer subs have been assembled with the last component usually being the adapter sub thereby completing the tool assembly.

Figure 5:
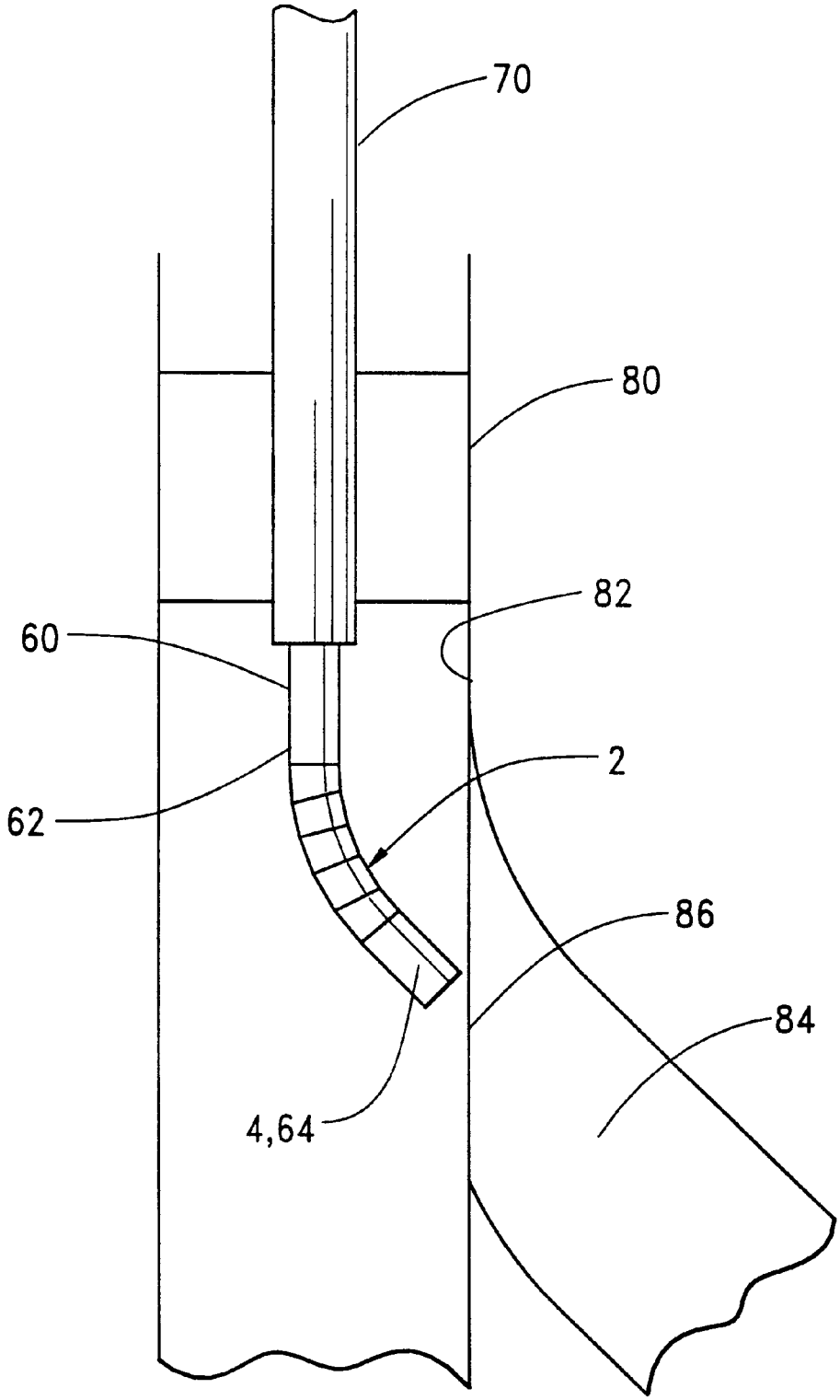
FIG. 5 is a conceptual view of a bending tool assembly in a primary wellbore and being deflected to allow it to enter a secondary laterally-oriented wellbore.

After the tool assembly has been installed onto a section of coiled tubing, such as tubing 60 shown in FIG. 5, the tool assembly is run downhole through, for example, a casing 70 having a packer 80 to seal the annulus between the casing and the wellbore. Upon reaching the desired depth, the tool assembly 2 is pressurized by way of surface pumps pressurizing a working fluid such as water and routing it through the coiled tubing through the internal bores of the tool assembly. Upon tool assembly 2 being pressurized internally, for example around 5000 pounds per square inch gauge, the individual bend segments will make an arc, or bend, toward wellbore 82 and jetting of the casing or well bore can begin. The bending is the result of the pressurization imparting forces that tend to move the individual bending elements away from each other longitudinally, but tangs 43 longitudinally retain adjacent shoulders 25 as well as shoulder 16 of the jetting sub 4 and shoulder 58 of the adapter sub. Because the tangs inhibit longitudinal motion on such respective sides of the bending elements, the opposite sides of the bending elements, the sides where retaining screws 44 are located, are forced longitudinally away from each other and due to the clearance between the tapered mandrel 22 and the respective bore which tapered mandrel 22 resides within. This results in an arc of approximately 3° per each bend element when the bend elements and the other components are constructed with the dimensions given in the example below. Thus, jetting head 4 is caused to move toward wellbore 82 by the cumulative amount of bend, or arc, of all the bend elements installed in tool assembly 2 upon sufficient internal pressurization of tool assembly 2.

An example of a tool assembly 2 for jetting was constructed wherein the geometry of the tool was as shown in the drawings with the various dimensions being as follows:

Dimension A—1.00 inch (25.4 mm)
Dimension B—0.75 inch (19.1 mm)
Dimension C—0.72 inch (18.3 mm)
Dimension D—0.74 inch (18.8 mm)
Dimension E—0.50 inch (12.7 mm)
Dimension F—1.00 inch (25.4 mm)
Dimension G—0.49 inch (12.3 mm)
Dimension H—1.03 inch (26.2 mm)
Dimension I—1.51 inch (38.4 mm)
Dimension J—0.10 inch (2.5 mm)
Dimension K—1.50 inch (3.8 mm)
Dimension L—1.50 inch (3.8 mm)
Dimension M—3.00 inch (7.6 mm)
Dimension N—1.75 inch (44.5 mm)
Dimension O—1.13 inch (28.7 mm)
Dimension P—2.02 inch (51.31 mm)
Angle $\alpha$—45°
Angle $\beta$—39.5 to 40.0°
Angle $\phi$—38.5 to 39.0°

When constructing the various components of the tool assembly to the above dimensions, each bend element being approximately 3 inches in overall length, provided approximately 3° of bend, or arc, per bend element within the bending tool assembly. The arc is primarily determined by the outside diameter and the taper of mandrel 22, the inside diameter and length of bore 30, and the distance between the end of bore 30 and the tip of mandrel 22, which in the embodiment shown in the drawings corresponds with the length of fluid passage bore 38. By considering these dimensions when constructing the bend elements, the arc and therefore the reach of each bending segment can be pre-calculated. Thereafter, a proper number of bend elements can be combined in order to obtain the total reach needed for the tool assembly to conduct a given job. Of course a tool assembly be could built using bend elements having differing bend characteristics, but it somewhat complicates the calculation of what the total reach would be for the tip of that tool assembly after having pre-selected the number of each differing bend elements. Table 1 shows the corresponding top angle, side reach, and tool length for each number of bend elements and retainer subs that could form a tool assembly as shown and described herein and having the dimensions set forth below. Although Table 1 shows 10 bend elements and 11 retainer subs, more could be added to form a bending tool assembly of a desired length provided limitations due to reactive forces from jetting are observed or compensated for.

TABLE 1

| NUMBER OF BEND ELEMENTS | NUMBER OF RETAINER SUBS | TIP BEND ANGLE (DEGREES) | SIDE REACH inches (mm) | TOOL LENGTH inches (mm) |
|---|---|---|---|---|
| 0 | 1 | 3 | 0.10 (2.5) | 5 (127) |
| 1 | 2 | 6 | 0.32 (8.1) | 7 (177) |
| 2 | 3 | 9 | 0.63 (16.0) | 9 (228) |
| 3 | 4 | 12 | 1.06 (26.9) | 11 (279) |
| 4 | 5 | 15 | 1.59 (40.3) | 13 (330) |
| 5 | 6 | 18 | 2.24 (56.9) | 15 (381) |
| 6 | 7 | 21 | 3.01 (76.4) | 17 (431) |
| 7 | 8 | 24 | 3.90 (99.0) | 19 (483) |
| 8 | 9 | 27 | 4.92 (124.9) | 21 (533) |
| 9 | 10 | 30 | 6.07 (139.6) | 23 (584) |
| 10 | 11 | 33 | 7.37 (187.2) | 25 (635) |

if radial jetting is not being conducted, such as when jetting axially or when using the subject bending tool for other operations such as a means for entering laterally-orieted wellbores as shown in FIG. 5, any number of bend elements can be used if an adequate internal hydraulic working pressure is achievable to overcome the effective weight of the tool assembly which is dependent upon the vertical and horizontal force components due to gravity acting upon the tool assembly.

When jetting or performing operations in which the exiting of liquids from a jetting nozzle, for example, causes a reaction force that tends to move the tip of the tool assembly away from the target surface. This back thrust can be quite powerful depending on the operating pressure, flow rate, and density of the working fluid as well as any fluid that may be present in the area surrounding the tool assembly. Therefore, it is recommended to calculate the maximum number of bend elements that can be installed within a tool assembly before the back thrust becomes great enough to move at least the jetting portion of the tool assembly away from the target surface. Furthermore, the orientation of the tool assembly in the wellbore, or more accurately the positions of the jetting nozzles when using the tool assembly in jetting operations, as well as the horizontal orientation of the well bore in non-vertical wells, often referred to as lateral or horizontal wellbores, has an effect on the amount of back thrust that a tool assembly can withstand prior to the tool assembly being forced away from the target when jetting. The following equations offer a practical prediction of the maximum number of bend units of a given length that can be assembled to form a bending tool assembly for a given operating pressure and a pre-selected jetting nozzle:

$$F=0.052\sqrt{P}$$

$$N = 15.104\ RS\frac{\sqrt{P}}{Ql\sin\alpha^{\circ}}$$

$$Q=25.36\sqrt{P}$$

$$N = 0.596\,S\frac{R}{dl\sin\alpha^{\circ}}$$

Where:

N=Number of Bend Elements or Units

P=Operating Pressure (psi)

S=Average Diameter of Tapered Mandrel (inches)

l=Length of Bend Sections Including Jet Tips (inches)

R=½ I.D. of Sleeve (inches)

α=Angle of Jet Nozzle

Q=Flow Rate of Fluid (gal/min)

d=I.D. of Jet Nozzle (inches)

F=Backthrust (lbs)

In light of the above calculations, it can be appreciated that the effective weight of the tool assembly can become quite significant when the tool assembly is being used in horizontal, or highly deviated, well bore applications and operating pressure, design criteria, and the number of bend elements must be considered and selected as appropriate for the direction in which the active jetting nozzle, or nozzles are positioned and are to be directed. For example, if the jetting head is laying essentially in a horizontal position and the jetting nozzle is directed upward at a 90 degree angle with respect to longitudinal center line of the tool assembly, the reactive forces of jetting could quite easily push the jetting head away from the targeted work area at a given pressure due to the gravitational forces acting on the tool assembly in the same direction as the reactive force from the jetting in a more pronounced fashion than if the tool assembly were positioned in a vertical wellbore.

A bending tool assembly constructed in accordance with the data set forth in the preceding Table 1 will when having a single jet with a liquid having the characteristics set forth in Table 2 below, will provide an exemplary bending tool that can be used to demonstrate the desired qualities and benefits offered by the subject bending tool assembly.

TABLE 2

| # of Jet Nozzles | 1 | |
|---|---|---|
| Fluid Weight | 8.3 lbs/gal | (1.00 kg/l) |
| Jet Nozzle Diameter | 0.092 inches | (2.337 mm) |
| Discharqe Coefficient | 0.95 | |
| Pressure Differential | 5000 psig | (351.5 kg/cm$^2$) |
| Q | 17.0104 gpm | (64.38 1/min) |
| Thrust | 62.5464 lbs | (278.21$^N$) |
| Weight Link | 1.5 lbs | (6.67$^N$) |
| Angle of Jet | 40° | |
| Diameter of pressured area | 0.75 in | (19.05 mm) |
| Diameter of Links | 1.5 in | (38.10 mm) |
| Bends per unit | 3 | |
| Length of unit | 2 in | (50.80 mm) |

Referring now again to FIG. 5 of the drawings, the subject bending tool need not be used solely to downhole jetting purposes but can also be used to guiding a tool string into a lateral or horizontal wellbore. In FIG. 5, a production casing 70 secured by a packer 80 set in vertical or main wellbore 82 is shown. Located below packer 80 is lateral wellbore 84 which joins main wellbore 82 at juncture 86. Coiled tubing 60, or other type of tubular conduit, has a pre-selected orienting tool 62 attached thereto. A bending tool assembly 2 having a jetting sub 4, or in addition to or in the alternative, having a miscellaneous tool 64 being attached to the end of tool assembly 2 is shown.

In practice, the tool string is run downhole through casing 70 until reaching such a depth that the orienting tool is activated to radially rotate the end of the tool so as to properly orient the bottom of the tool string for entry into lateral wellbore 84. Coiled tubing 60 is then internally hydraulically pressurized to a sufficient pressure so as to cause bending tool 2 to bend or curve sufficiently to cause the bottom of the tool string to enter lateral wellbore 84 at the juncture 86 upon further running the tool string deeper. Such bending can be achieved without the need to raise or lower the workstring longitudinally, or to weight and unweight the workstring, in order to activate the bending of the tool assembly as such bending is done with internal hydraulic pressure and not physical manipulation of the tool string. This makes the subject tool assembly very attractive when the use of coiled tubing is called for in operations to be conducted within either horizontal or vertical wellbores.

It will be appreciated and understood that variations of the disclosed and illustrated embodiments of the subject invention may be made without departing from the spirit and scope of the invention as claimed.

what is claimed is:

1. A pressure activated bendable tool assembly having a longitudinal centerline, the tool assembly comprising:

a) an adapter means for connectedly adapting the tool assembly to an end of a tubular member, the adapter means having a bore extending longitudinally therethrough and having a means for providing a fluid connection between the tubular member and the tool assembly;

b) at least one bend element means having a bore extending longitudinally therethrough, the bore being in fluid communication with the bore of the adapter means, said bend element being axially retained with said adapter means;

c) a first retainer sleeve means for axially retaining said bend element means, and said adapter means, the retainer sleeve means further having a means for limiting the amount the bend element means may be longitudinally displaced from the adapter means about a preselected side of the retainer sleeve element;

d) a head-sub means for forming a distal end of the tool assembly opposite of the adapter means; and wherein the tool assembly bends with respect to the longitudinal centerline a preselected amount upon inducing a pressure differential between the respective bores of the adapter sub, the bend elements, and the head-sub and the ambient pressure of the tool assembly.

2. The pressure activated bendable tool assembly of claim 1 further comprising: an additional sleeve retainer means for retaining the adaptor means and the first bend element means in a preselected relationship and the additional sleeve retainer means further having a means for limiting the amount the adaptor and the first bend elements may be longitudinally displaced from each other about a preselected side of the sleeve retainer upon the respective bores of the tool assembly being subjected to a pressure differential.

3. The pressure activated bendable tool assembly of claim 1 further comprising: the head-sub being a jetting sub having a jetting nozzle means for directing a jetted spray from the jetting sub.

4. The pressure activated bendable tool assembly of claim 1 further comprising: a plurality of bend elements positioned in a serial relationship and wherein at least one bend element has a hollow mandrel extending therefrom size and configured to be accommodated by the bore of the bending element positioned in serial proximity thereto.

5. The pressure activated bendable tool assembly of claim 4 further comprising: the hollow mandrel of the at least one bend element having a tapered outside diameter.

6. The pressure activated bendable tool assembly of claim 5 wherein the tool assembly arcs approximately 3 degrees for each bend element installed in the tool assembly.

7. The pressure activated bendable tool assembly of claim 4 further comprising: seal means for fluidly sealing the mandrel within the mandrel accommodating bore of the bending element.

8. The pressure activated bendable tool assembly of claim 7 wherein the seal means comprises elastic O-ring seals nested within respective grooves within the mandrel accommodating bore of the sleeve retainer means.

9. The pressure activated bendable tool assembly of claim 1 further comprising: the sleeve retainer means having opposing tangs on the inside of the sleeve retainer and located on a preselected side of the retainer means for engaging external shoulders located on the respective bend elements in which the sleeve retainer means are to be installed about.

10. The pressure activated bendable tool assembly of claim 9 further comprising: the sleeve retainer means having lock means located on the opposite side of the side of the sleeve retainer means having the tangs.

11. A pressure activated downhole bendable tool to be installed on the end of a segment of coiled tubing comprising:

a) an adapter sub for adapting the tool assembly to a a coiled tubing end fitting, the adapter sub having a mandrel extending longitudinally therefrom and the adapter sub having a bore extending through the sub and the mandrel;

b) at least one bending element fluidly connected to the adapter sub by way of the adapter sub mandrel, the at least one bending element having a mandrel extending longitudinally therefrom and the bending element having a bore to accommodate a mandrel extending through the element and the mandrel, the bore opposite of the mandrel being sized and configured to accommodate the mandrel of the adapter sub, the bending element having opposing circumferential shoulders, the shoulders having a notch on a preselected side of the bending element;

c) a plurality of sleeve retainers sized and configured to encompass a portion of the adapter sub and bend element, the sleeve retainers having a pair of oppositely positioned tangs of a preselected width, length, and depth protruding inwardly from the internal surface from a preselected side of the sleeve retainer, the sleeve retainer further having at least one locking means to secure the sleeve retainer about each pair of members which it is to retain;

d) a head-sub for terminating the distal end of the tool assembly opposite of the adapter sub, the head sub being fluidly connected to at least one bending element by way of the bending element mandrel and a bore in the head-sub accommodating the bending element mandrel; and wherein the tool assembly bends with respect to the longitudinal centerline a preselected amount upon inducing a pressure differential between the respective bores of the adapter sub, the bend elements, and the head-sub and the ambient pressure of the tool.

12. The tool assembly of claim 11 further comprising: the bend elements and the head sub having bores configured to accommodate seal means for providing a fluid seal about the external surface of the mandrel and the respective bore.

13. The tool assembly of claim 12 further comprising: the seal means being elastic O-rings.

14. The tool assembly of claim 11 wherein at least one member selected from the group of the bending elements, sleeve retainers, head-sub and adapter sub is made of stainless steel.

15. The tool assembly of claim 11 wherein the lock means are threaded set screws which when installed protrude partially into respective notches in the shoulders in the sleeve retainers without hindering the operation of the tool assembly upon pressurization.

16. The tool assembly of claim 11 further comprising a preselected number of bending elements fluidly connected in a serial arrangement by way of respective mandrels being accommodated by respective bores in adjacent bending elements, and further comprising a plurality of sleeve retainers to retain the plurality of bending elements.

17. The tool assembly of claim 11 further comprising the head-sub having a jetting bore in fluid communication with the respective bores of the preceding bending elements and adapter sub.

18. The tool assembly of claim 17 wherein the jetting bore has a jetting nozzle installed therein.

19. The tool assembly of claim 11 further comprising the head-sub being a jetting sub having a plurality of jetting bores having respective jetting nozzles installed therein and in fluid communication with the respective bores of the preceding bending elements and adapter sub, wherein the jetting bores and respective nozzles are positioned to provide spray induced forces for counteracting spray induced forces from oppositely positioned jetting nozzles.

20. The tool assembly claim 11 wherein the head-sub is suitable for entering and guiding the tool in multi-lateral wellbores, and wherein the wellbores may be of any angle with respect to vertical.

* * * * *